US009409660B2

(12) United States Patent
Kaufman

(10) Patent No.: US 9,409,660 B2
(45) **Date of Patent: *Aug. 9, 2016**

(54) HIGH PRESSURE FOOD PACKAGE AND SYSTEM

(71) Applicant: Galen D. Kaufman, Houston, TX (US)

(72) Inventor: Galen D. Kaufman, Houston, TX (US)

(73) Assignee: The Fizzy Fruit Company, Inc., Houston, TX (US)

( * ) Notice: Subject to any disclaimer, the term of this patent is extended or adjusted under 35 U.S.C. 154(b) by 586 days.

This patent is subject to a terminal disclaimer.

(21) Appl. No.: 13/910,086

(22) Filed: Jun. 4, 2013

(65) Prior Publication Data

US 2014/0007546 A1 Jan. 9, 2014

Related U.S. Application Data

(60) Provisional application No. 61/667,434, filed on Jul. 3, 2012.

(51) Int. Cl.

| | |
|---|---|
| ***B65B 3/00*** | (2006.01) |
| ***B65B 31/02*** | (2006.01) |
| ***B65D 81/20*** | (2006.01) |
| ***B65D 51/16*** | (2006.01) |
| *B65B 31/04* | (2006.01) |

(52) U.S. Cl.

CPC ..... *B65B 3/00* (2013.01); *B65B 31/025* (2013.01); *B65D 51/1638* (2013.01); *B65D 51/1677* (2013.01); *B65D 51/1683* (2013.01); *B65D 51/1688* (2013.01); *B65D 81/2076* (2013.01); *B65B 31/043* (2013.01)

(58) Field of Classification Search

CPC ..... B65B 3/00; B65B 31/025; B65B 31/043; B65D 51/1638; B65D 51/2076; B65D 51/1677; B65D 51/1683; B65D 51/1688

See application file for complete search history.

(56) References Cited

U.S. PATENT DOCUMENTS

| | | | | |
|---|---|---|---|---|
| 5,968,573 | A * | 10/1999 | Kaufman | A23L 1/2123 426/302 |
| 2007/0292568 | A1* | 12/2007 | Kaufman | B65D 17/163 426/124 |
| 2008/0057163 | A1* | 3/2008 | Kegler | A23B 7/148 426/129 |
| 2008/0175966 | A1* | 7/2008 | Kaufman | A23B 7/148 426/397 |

* cited by examiner

*Primary Examiner* — Erik Kashnikow
*Assistant Examiner* — Chaim Smith
(74) *Attorney, Agent, or Firm* — J. Douglas Wells

(57) ABSTRACT

Methods and apparatus utilizing a high pressure food package involving filling a cup with a quantity of food product chosen so as to be capable of absorbing sufficient CO2 to produce effervescence easily detectable by a person later removing and consuming the food product, introducing CO2 into the cup, closing the lid, pressurizing the interior space with CO2 and generating sufficient effervescence in the food product, applying an anti-tamper feature to the closed cup, allowing the internal pressure of CO2 to increase and stabilize, transporting and holding the package for retail sale, providing means for a consumer to depressurize the package before removing the lid, and providing means for a consumer to hold the cup in one hand and twist off the lid with another hand, and to use fingers of one hand to remove the carbonated food product from the cup.

16 Claims, 9 Drawing Sheets

HIGH PRESSURE FOOD PACKAGE AND SYSTEM

CROSS REFERENCE TO RELATED APPLICATIONS

This application claims the benefit of U.S. provisional application Ser. No. 61/667,434 filed on Jul. 3, 2012.

TECHNICAL FIELD OF THE INVENTION

The disclosure herein generally relates to designs for a high pressure food package and system and, more particularly, to designs for a modified atmosphere food package that is capable of retaining a high internal pressure, releasing that pressure safely, and methods for using the same.

BACKGROUND OF THE INVENTION

Modified atmosphere packaging generally refers to the practice of modifying the composition of the internal atmosphere or headspace of a package in order to improve the shelf-life of the product. The product is typically a food product but may also include pharmaceuticals or other types of products. The modification usually involves attempts to lower the amount of oxygen in order to slow down the growth of aerobic organisms and the speed of oxidation reactions. The removed oxygen is typically replaced with nitrogen, commonly known as an inert gas, or carbon dioxide, which can lower the pH or inhibit the growth of bacteria.

In the context of food products, modified atmosphere packaging is generally considered a technique used for prolonging the shelf-life of fresh or minimally processed foods. In this preservation technique, the air surrounding the food in the package is changed to another composition using, for example, a gas-flush process. The initial fresh state of the food may be prolonged by slowing the natural deterioration of the food product. Respiring foods such as fruits and vegetables continue to take in oxygen and give off carbon dioxide as they continue to respire and ripen after harvest. Refrigeration and controlled atmosphere storage methods may be used to retard the ripening process. Reducing temperature slows the produce metabolism, including the rate of respiration. Under controlled atmosphere storage, respiration and ripening may be reduced further by lowering the oxygen content of the air, which normally consists of approximately 21% oxygen, 78% nitrogen, and 1% other elements.

A recent need for using modified atmospheres, specifically carbon dioxide (CO2), is to enhance the flavor of foods by creating an effervescent character during tasting (e.g. U.S. Pat. No. 5,968,573, which is incorporated herein by reference). This method involves the generation of positive CO2 pressure within a sealable container filled with food such that the CO2 diffuses by osmosis into the water content of the food. The development of carbonated foods (e.g. Fizzy Fruit™) has created a need for a safe and convenient package to distribute single servings.

One example of a package directed to retaining a positive pressure atmosphere within the package is a tennis ball can (or tennis ball tube). The air pressure inside a tennis ball is typically 12 psi (pounds per square inch) greater than the ambient air pressure at sea level. Over time, air escapes from the inside of the ball causing a decrease in the amount of air pushing on the inside of the ball and, consequently, decreasing the bounce characteristics of the ball. To prevent the ball from becoming "flat," the ball is packaged in a positive pressure tube, with the tube pressurized to around 12 psi, which is enough to prevent air from escaping from the inside of the ball. Another example of a positive pressure package is the ubiquitous soda bottle, which is directed to maintaining carbon dioxide saturated liquid under pressures of up to 50 psi.

Designs for a high pressure food package and system that provides a sufficiently pressurized and controllable gaseous environment are needed. Such designs need to be applicable for use with the carbonated fruits or vegetables products described in U.S. Pat. Nos. 5,968,573 and 7,228,793, and U.S. patent application Ser. Nos. 10/857,043, 11/453,712, 11/454,814, 11/548,212, 11/943,964, and 12/271,797, all commonly owned or licensed by The Fizzy Fruit Company and each of which is incorporated herein by reference.

BRIEF DESCRIPTION OF THE SEVERAL VIEWS OF THE DRAWINGS

For a more complete understanding of the present invention, the drawings herein illustrate examples of the invention. The drawings, however, do not limit the scope of the invention. Similar references in the drawings indicate similar elements.

DETAILED DESCRIPTION OF PREFERRED EMBODIMENTS

Figure 1A:
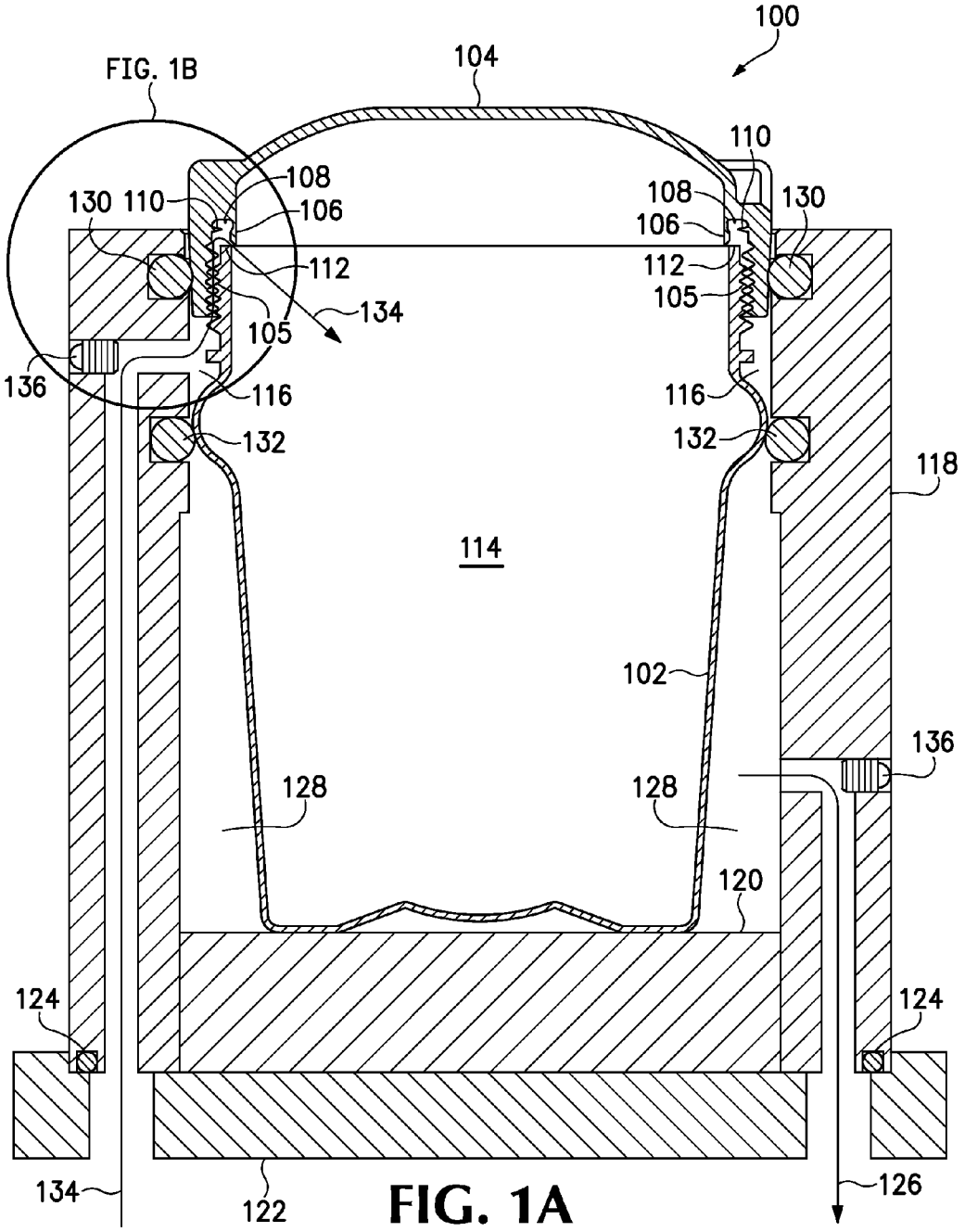
FIG. 1A is a sectional side view of an exemplary high pressure food package and system.

In the following detailed description, numerous specific details are set forth in order to provide a thorough understanding of the preferred embodiments. However, those skilled in the art will understand that the present invention may be practiced without these specific details, that the present invention is not limited to the depicted embodiments, and that the present invention may be practiced in a variety of alternate embodiments. In other instances, well known methods, procedures, components, and systems have not been described in detail.

Various operations may be described as multiple discrete steps performed in turn in a manner that is helpful for understanding the preferred embodiments. However, the order of description should not be construed as to imply that these operations are necessarily performed in the order they are presented, nor even order dependent. Lastly, repeated usage of the phrase "in one embodiment" does not necessarily refer to the same embodiment, although it may.

As an overview, the present inventors determined that designs for a high pressure food package and system are needed that provide a package with a sufficiently pressurized and controllable gaseous modified atmosphere for a quantity of food product, such as, for example, fresh-cut fruits or vegetables, yet at the same time remains safe, easy to open and use, re-sealable, and portable. However, the present inventors discovered that some types of packaging are less desirable because: the package may have too small of an opening to allow for easy access to food pieces (i.e. the package was designed (by others) for other types of (liquid) products); the package is not capable of maintaining the positive pressure levels necessary to effectively enhance the flavor of foods (i.e. effervescence); and/or the package comprises materials and methods that do not readily fit into the recycling stream. For example, one package under development for carbonating foods uses an aluminum lid seamed to a plastic cup. This makes recycling more difficult because of the tight weld between the two materials, which cannot be separated easily enough using existing reclaiming methods. This aluminum/plastic type of package may also create potentially dangerous metal edges if the package were to burst open from too much internal pressure, for example from internal fermentation of the food product. Consequently, the present inventors determined that not only is it desirable that the new package hold sufficient internal pressure, but it is desirable that the new package be capable of automatically releasing excessive internal pressure.

The present inventors discovered that for some types of packaging, once a container with a fixed amount of food is initially pressurized to its maximum level with gas and then sealed, the gas in the head space will gradually diffuse into the tissues of the food product and reduce the overall internal pressure within the package. The reduced internal pressure level may not be sufficient to produce the intended strongly enhanced or effervescent flavor profile for the particular food product. In testing one embodiment of the aluminum/plastic type package described above, after the initial gas pressurization to the package's maximum capability (i.e. approximately 35 psi), the pressure equilibrates after diffusion into the tissues of the food product so as to reduce the internal pressure of the package to only about 20 psi, resulting in weaker effervescence than desired.

The present inventors further discovered that with various other methods for enhancing food flavor with carbon dioxide, the level of carbonation (or absorbed carbon dioxide) varies with the internal pressure of carbon dioxide during the step of maintaining the internal pressure within the package or container. The inventors discovered that this relationship can be controlled by pressure devices that are capable of setting a specific internal pressure level of carbon dioxide, and that this resulted in an effervescent (or "fizzy") tasting intensity that can be reproduced more reliably. A "fizziness" scale from 1 to 5 (with 5 being the most effervescent) was developed by the inventors to qualitatively describe this relationship to internal CO2 pressure. However, the inventors determined that existing packaging systems are not capable of controlling and maintaining the internal pressure level at specific levels, especially high levels.

The present inventors invented a high pressure food package and system that provides, in various embodiments: a high pressure food package comprising a sealable container having a wide mouth cup and lid, the sealable container suitably designed for holding a quantity of non-liquid food product, and an integral or separate gas seal within the sealable container capable of retaining and maintaining a positive pressure within the sealable container, the gas seal configured so that the positive pressure inside the container energizes (i.e. makes stronger) the seal. The system includes a collar and apparatus capable of holding the container and filling the container through its seal during partial closure of the lid onto the cup with a desired quantity of gas to create a specific sensory level of effervescence.

Various embodiments are described, some of which incorporate features for manual or automatic release of, possibly excessive, internal pressure prior to opening. Excessive internal pressure might be caused by heating, pressure differentials, internal fermentation of the product contained, or other factors.

In one embodiment, the package is capable of providing a pressurized carbon dioxide rich atmosphere, initially to approximately 60-90 psi, and equilibrating to approximately 40 psi, for carbonating or maintaining the carbonation of a quantity of food, such as fruits or vegetables. In one embodiment, an optimum amount of oxygen is provided in the gas mixture to avoid dangerous anaerobic conditions if the food product is not itself inherently toxic (e.g. acidic) to such pathogens. The gas mixture may comprise a predetermined combination of CO2 and O2. For example, the gas mixture may comprise 95% CO2 and 5% O2 in order to provide an effervescent character to the food product yet prevent anaerobic microbial growth (e.g. *C. botulinum*).

In one embodiment and a separable aspect, a collar apparatus holds the cup down with a vacuum while filling through the threaded seal and partially closed lid the desired volume and composition of gasses internally. The desired volume is detected by a pressure sensor which stops the filling and releases the vacuum after the lid is tightened to a specific torque level. In one embodiment, an apparatus fills the package mechanically with the desired modified atmosphere to a controllable level of pressure.

In one embodiment and another separable aspect, the high pressure food package comprises a sealable container having a wide mouth cup and lid, the lid having on its surface a one-way valve through which gas may be injected into the container, and a foil liner or other membrane suitably designed so as to burst when internal pressure within the container exceeds a predetermined level. For example, the high pressure food package may comprise a lid having a one-way membrane type valve as well as a foil liner. In one embodiment, the foil liner is sealed to the rim of the cup whereafter gas may be injected into the container through the one-way valve. In one embodiment, a hand operated gas filling device may be used for injecting the gas into the sealed container (for example, through a one-way valve).

In another separable aspect of the invention, the high pressure food package comprises a sealable container having a wide mouth cup and lid, the lid having on its surface a single-use push-pin through which gas may be released from the container prior to opening.

In another embodiment and another separable aspect, a lid can be designed as an 'adapter' that can be filled from existing standard soda bottle assembly lines but on the other side has the necessary wide-mouth for sealing and emptying large pieces of food (fruit and/or vegetables).

In one embodiment, the one-way valve is in the nature of a bicycle tire Schrader or Presta poppet type valve which could be used to inject CO2 or any modified atmosphere but also safely release it prior to opening the package.

Turning now to FIG. 1, a sectional side view of an exemplary high pressure food package and system is shown. It can be seen that one embodiment of the package system 100 includes a polyethylene terephthalate (PET or PETE) plastic wide mouth cup 102 and polypropylene (PP) lid 104 joined with four (12 pitch, 0.083") interrupted threads 105 and a built in one or more point seal 106, 108, 110 inside the lid which comes into contact with the top rim 112 of the cup during tightening. Preferably, the rim 112 defines an opening into the cup 102 that is wide enough to allow finger access to chunks or pieces of non-liquid food product previously introduced into the cup 102. Other materials may be used for the cup 102 and lid 104, and the one or more point seal 106, 108, 110 may be formed integral to the cup 102 or lid 104 or may comprise separate components suitably fit to the cup 102 or lid 104 so as to provide a sealing function. As shown, seal 106 comprises a flap of material, annular in shape, formed integral to the lid 104, and allows for gas to flow into the cup interior space 114 but prevents gas from flowing back out of the interior space 114 when the pressure in the space 114 exceeds an opposing pressure external to the cup 102 and lid 104 (and acting through the threads 104). The lid 104 may include a one or more point seal 108, 110 that engage with surfaces proximate to the rim 112 when the lid 104 is tightened downward upon the cup 102. The threads 105 may or may not be interrupted type threads and may comprise other configurations in terms of pitch, size, and count.

A pressure chamber 116 is formed by collar housing 118, support block 120, bottom O-ring 124 and base plate 122, which together hold the (as shown, partially closed) cup 102 and lid 104 assembly down by means of a vacuum 126 created in the pressure chamber 128 against the barrier of the cup and lid touching the upper 130 and lower O-rings 132.

When the vacuum 126 is applied, the cup and lid assembly is held down while the desired gas 134 (e.g. CO2) is pumped into the package through the threads 105 apposing and joining the cup 102 and lid 104. The detail view in FIG. 1B shows the path of the gas by the arrow 134. As shown, a plug 136 may be used to block off additional access to the flow path 138 for the gas 134. A flap of lid material 106 acts as a one-way valve allowing pressure to build within the interior space 114 of the package. When a desired internal pressure is detected, the pressurization stops and is removed, and the same flap 106—due to its elasticity—acts to seal the pressure inside the package by way of its apposition against the cup rim 112. The internal pressure itself acts to energize this seal 106.

In various embodiments the package may comprise a screw lid which can hold pressure by means of an integral or separate pressure energized seal. The seal, such as the material flap 106 shown, is forced against the edge of the cup 102 and lid 104 (proximate to the rim 112) in such a way as to provide a very low torque required to open the cup and lid package. Other screw cap designs require a compression force between the lid/seal and cup/seal, but in the arrangement shown in FIGS. 1A-1B the material flap seal 106 provides a greater sealing force as the pressure is increased within the cup. The gas filling method may use a partially engaged seal and still allow pressure to build inside the cup because the differential pressure between the collar chamber and the package would flex the material flap seal 106 inward, creating a gas flow path 134. An adhesive strip may be applied over the junction of the cup 102 and lid 104 to prevent inadvertent lid rotation and to provide indication of product tampering.

Several different embodiments of a pressure energized seal, using one or multiple points of contact between the lid 104 and the cup 102, may be used. The seal may be integral (part of the lid 104) or separate (such as an O-ring) or applied as a different material coated onto the lid 104. For example, the seal may be a soft but durable substance such as silicon sprayed onto the surface of the lid. Additional material might be added to the screw threads 105 (on either or both of the cooperatively sized threads on the lid 104 and cup 102) to assist in sealing.

Figure 7:
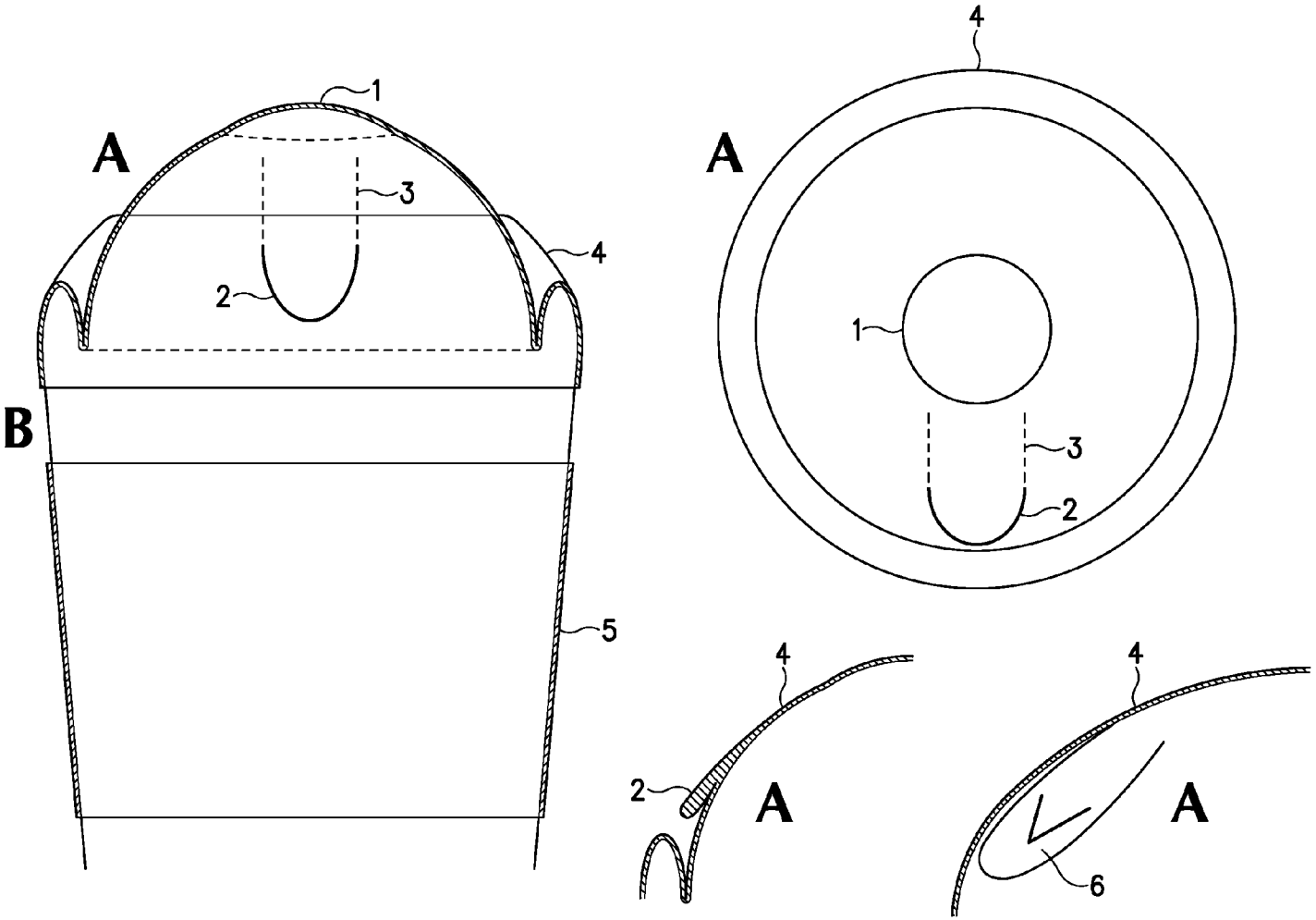
FIG. 7 illustrates top and cut side views of another exemplary high pressure food package having a lid with a rim gripping seal and pressure releasing pull-tab.

Another embodiment may include curved fitted forms at the edge of the lid 104 and cup 102 as shown by example in FIG. 7, such that internal pressure inside the package holds the lid and cup together by means of the apposition of the forms, which fit together like two spoons.

In one embodiment, the lid 104 after package pressurization (i.e. after filling the package with gas) is tightened (to a specific torque) against the cup 102 by means of a torque wrench fitted to grab the lid using small fins protruding from the lid exterior surface for traction/grip. Preferably, opening the pressurized container (or depressurization) is accomplished by turning the lid to allow pressurized gas within the package to vent through the screw threads 105. Re-tightening or re-sealing the lid 104 after opening the package may provide extended retention of the modified atmosphere in product remaining in the package. Preferrably, the re-sealed package is capable of retaining a positive internal pressure (as gas escapes from the food product and into the internal space 114 within the package or if additional gas is injected into the re-sealed package) so as to extend, maintain, or improve the effervescent character of the remaining product.

In one embodiment, PETE plastic may be used for one or both of the cup 102 and lid 104 and may be "oriented" such that overpressure first stretches and then rips longitudinally to prevent shrapnel. Preferably, materials used for the cup 102 and lid 104 comprise food-grade materials suitable for holding food product and are recyclable using currently available reclaiming/recycling methods. Preferably, the materials and designs used for the cup and lid package are such that the package is able to safely maintain internal pressures (measured as the differential pressure above ambient or external pressure, at sea level) of up to 90 psi so as to handle varied market conditions, for example, hot days, air travel, and dropping the package. More recently, polymers of plant sources which are biodegradable could also be engineered to meet these requirements.

In one embodiment, different colors of material may be used for one or both of the cup 102 and lid 104 to indicate the specific content of the package. For example, different colors may be used for particular types or combinations of fresh cut or minimally processed fruits or vegetables that may comprise the packaged product. As another example, a particular color may be used for packaged carbonated fresh fruit, and a different color may be used where the non-liquid food product comprises high viscosity sauces or smoothies.

Figure 1B:
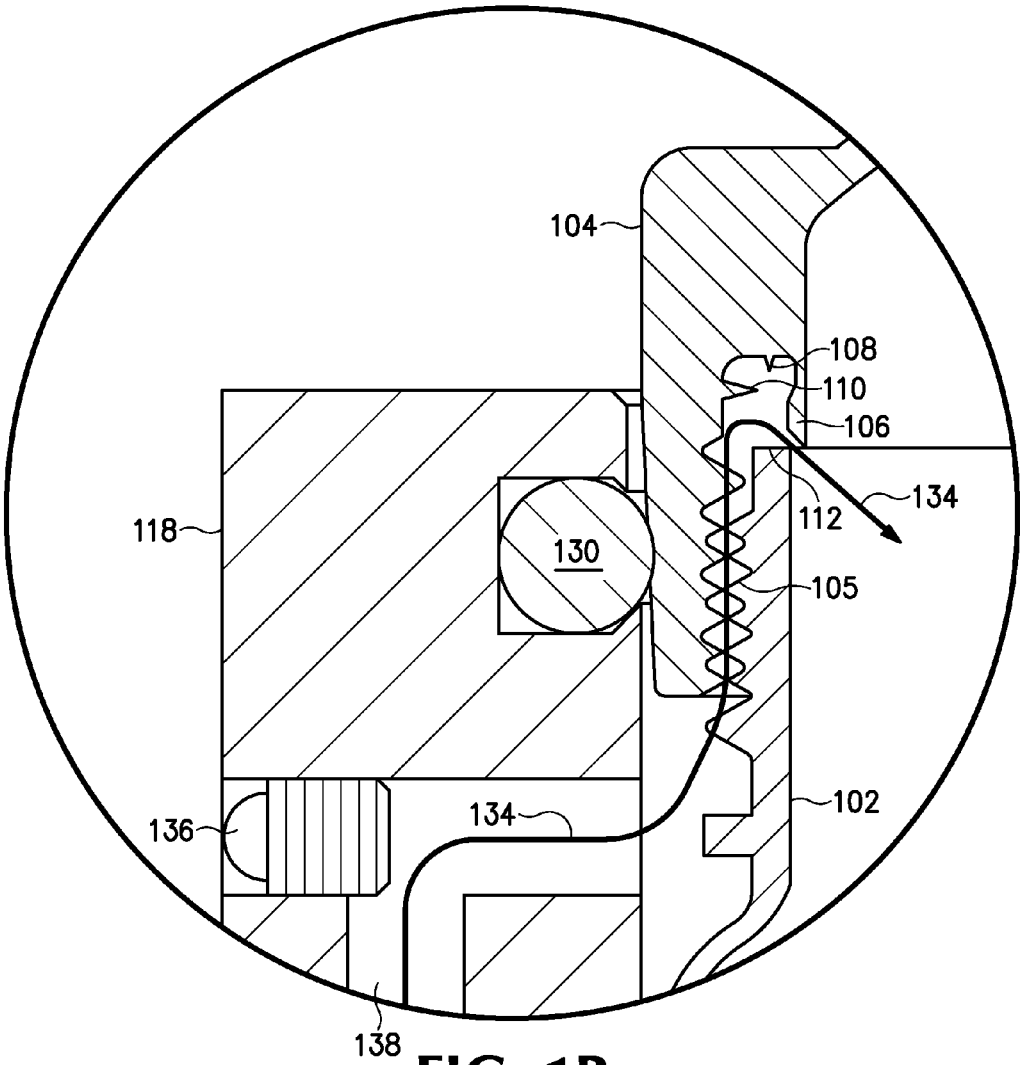
FIG. 1B is a detail sectional side view of a seal and thread region of the high pressure food package and system of FIG. 1A.
Figure 2:
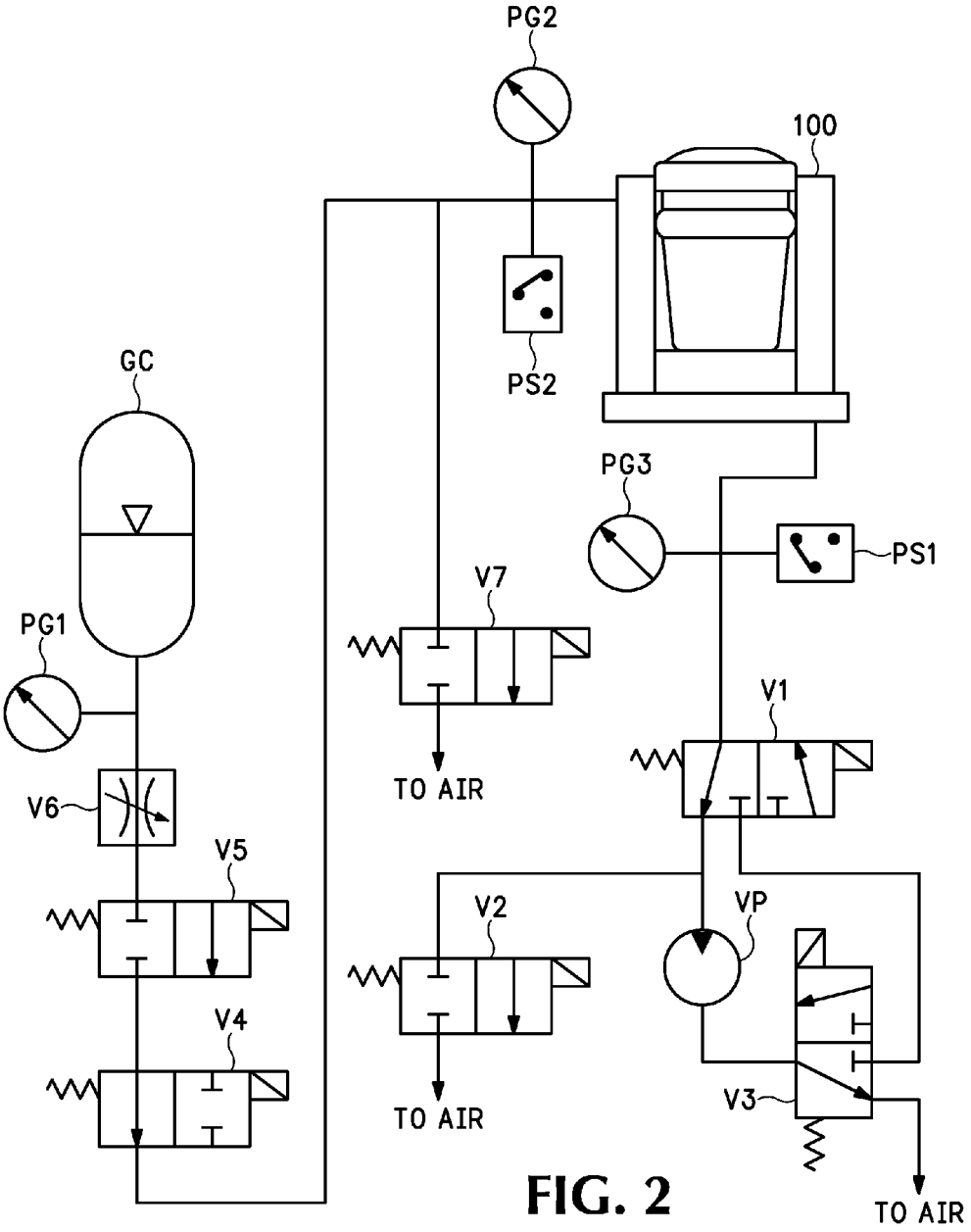
FIG. 2 is an exemplary schematic for a pneumatic system for use with the high pressure food package and system of FIG. 1A.

Now referring to FIG. 2, an exemplary schematic for a pneumatic system for use with the high pressure food package and system of FIG. 1A is provided.

In one embodiment, the package system 100 may be controlled by a series of valves and switches so that the simple action of dropping a partially closed cup and lid assembly into the housing 118 while pressing a foot switch results in a sequence of events that holds the package down by vacuum, pressurizes the internal space 114 of the package through the threads 105 and one-way or material flap seal 106, allows for tightening of the lid 104 to the cup 102, and then releases the pressurized package by reversing the vacuum 126 underneath the package to a positive pressure which ejects the filled package.

In one embodiment, a foot switch (not shown) starts a vacuum pump VP, which when the vacuum is sufficient (determined using pressure gauge #3 PG3) to hold the cup down activates pressure switch #1 PS1 to open valve #5 V5, which begins filling the package with gas from a gas cylinder GC. When the desired internal package pressure is reached (e.g. 50 psi) and detected by gauge #2 PG2, pressure switch #2 PS2 activates five valves, valve #1 V1, valve #2 V2, valve #3 V3, valve #4 V4, and valve #6 V6, which cycle and reset the system as described.

When the pressure through the seal is discontinued, the remaining internal pressure inside the package energizes the seal 106 and maintains the internal pressure while the step of tightening the lid occurs.

The package is filled with a desired gas mixture to a preset pressure through the threaded lid during sealing, resulting—after equilibration of the gas into the product—in a desired level of effervescence in the product. If a scale is described from 1 to 5, where 1 is barely detectable effervescence, and 5 is visible and auditory effervescence (bubbles bursting from the product), the system preferably is capable of consistently reproducing any level of effervescence required in the product. The amount of effervescence is preferably made according to characteristics of the target consumer. For example, children might prefer more effervescence than adults. Younger consumers might prefer more effervescence in the product (e.g. an effervescence or Fizzy rating of approximately 4, or even higher at approximately 5) whereas older consumers might prefer less (e.g. an effervescence or Fizzy rating of approximately 3, or perhaps lower).

To achieve the desired effervescence and, therefore, the corresponding internal equilibrium pressures, the initial pressure is preferably greater than the subsequent equilibrium pressure in order to allow for the diffusion of gas into the product over time (e.g. a number of hours). The relationship of the initial to equilibrated pressure is a function of the mass of gas added and the headspace volume existing outside of the product within the package, according to the following equation:

$$\frac{P_1V_1 - P_2V_2}{T_1T_2} = (n_1 - n_2)R$$

Where, $P_1$=The initial pressure inside cup $P_2$=The equilibrium pressure inside the cup $n_1$=Initial number of moles of CO2 in the headspace of the cup $n_2$=Number of moles of CO2 left in the head space after the absorption of CO2 into the fruit reaches equilibrium at a given pressure and temperature $n_1$-$n_2$=The number of moles of CO2 that has been absorbed by the product; this depends on the amount of moisture inside the product and is relatively constant for a given product at a given temperature and pressure R=Universal gas constant=8.3145 J/mol K $V_1$ is the volume of cup after initial pressurization $V_2$ is the volume after pressure reaches equilibrium. If the volume change of the cup under the pressure is negligible, i.e, V1=V2=V $T_1$ is the initial temperature inside the cup $T_2$ is the temperature inside the cup after pressure equilibrium is reached If the cup is stored under refrigerated conditions, assume $T_1$=$T_2$=T, then equation 1 becomes:

$$\frac{(P_1 - P_2)V}{T} = (n_1 - n_2)R$$

However, for a given volume of product inside a cup, if you increase the headspace or the volume of the cup, $V_1$, it will increase the initial number of moles of CO2, i.e., $n_1$ or the mass of CO2 inside the cup. In this way one can increase the fizziness level using the same initial pressure.

Figure 3A:
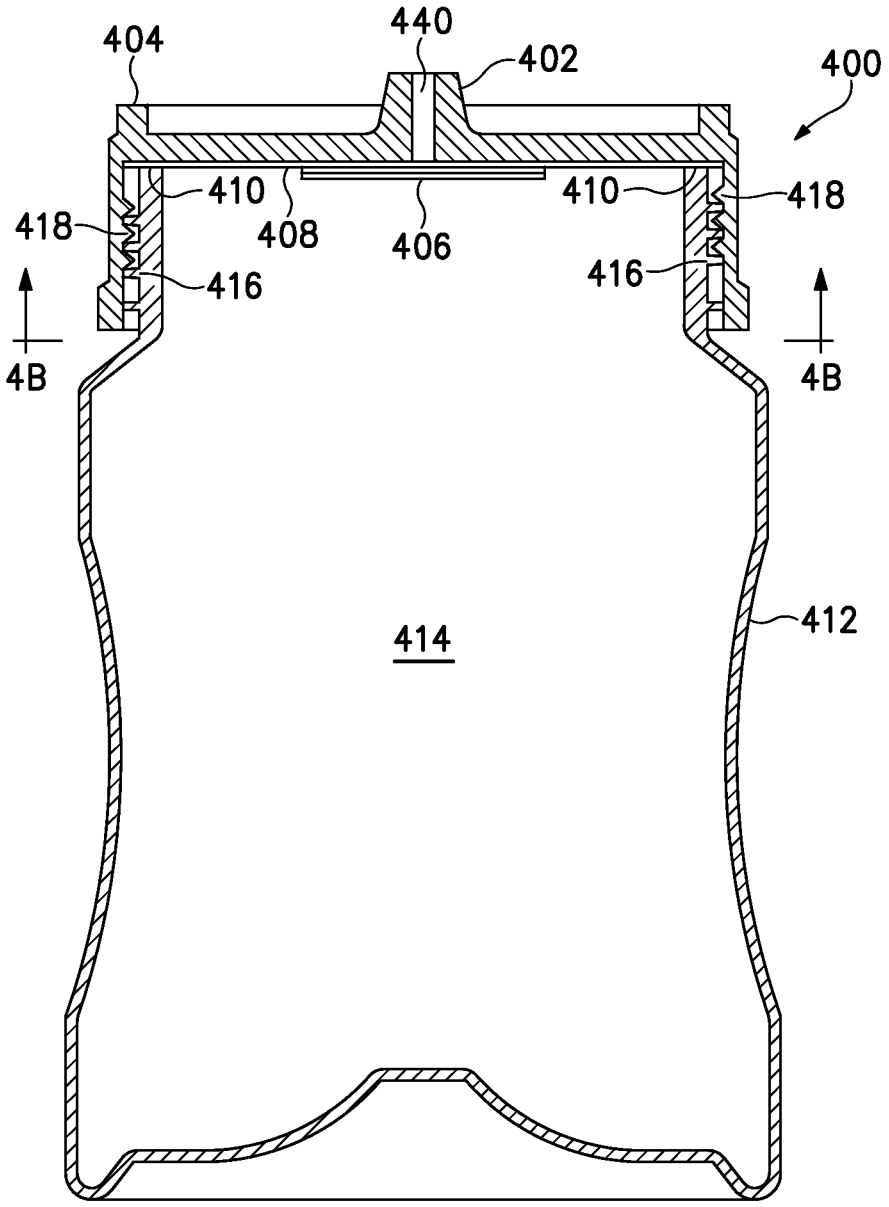
FIG. 3A is a cut side view of an exemplary high pressure food package having a one-way valve and an overpressure feature.

Turning now to FIG. 3A, a cut side view of an exemplary high pressure food package that involves an overpressure feature is provided. In one embodiment, CO2 to pressurize the package 400 and generate the desired effervescence is forced through a nipple 402 in the center of the plastic cap 404 through a one-way membrane valve 406 covering a central hole in a foil induction seal liner 408 that has been electrothermally welded to the edge or rim 410 of the plastic bottle 412. A production method for such package may comprise of first filling an interior space 414 of the bottle 412 with a quantity of food product, then torquing the cap 404 including the foil liner 408 and one-way valve 406 onto the cup or bottle 412 at a predetermined force, putting the cap 404 and bottle 412 through a device to electrothermally weld the foil liner 408 to the cup edge 410 thus creating the seal, and finally filling the package 400 with CO2 gas through the nipple 402 on the cap 404. The cap 404 is preferably torqued to the bottle at a predetermined force that is low enough for easy hand removal of the cap (i.e. for use by children). The foil liner 408 provides an overpressure safety feature. If the internal pressure within the package exceeds a predetermined threshold, for example due to excessive heating of the pressurized package, the foil liner 408 is preferably designed to burst, typically near the rim 410, or separate slightly from the rim 410 thereby releasing pressure from within the package. Other materials, such as a membrane liner or a plastic film, may be used for the overpressure safety feature, and such materials may be applied using a process other than an electrothermal (i.e. induction or radio frequency (RF) heating) process to seal the material to the rim 410.

In various embodiments, the bottle 412 may comprise a cup 102 as in FIG. 1A or share one or more of the characteristics of the cup 102 previously described. Likewise, the cup 102 in FIG. 1A may comprise one or more of the characteristics of the bottle (or cup) 412 as in FIG. 3A. Similarly, the lid 104 in FIG. 1A and the cap (or lid) 404 in FIG. 3A may share one or more characteristics. For example, in one embodiment, the bottle 412 comprises threads 416 which cooperatively mate with threads 418 formed on the cap 404. However, as shown in FIG. 3A, the cooperatively mating threads 416, 418 are shaped differently than the threads 105 shown in FIG. 1A. Other thread shapes may be used.

Figure 3B:
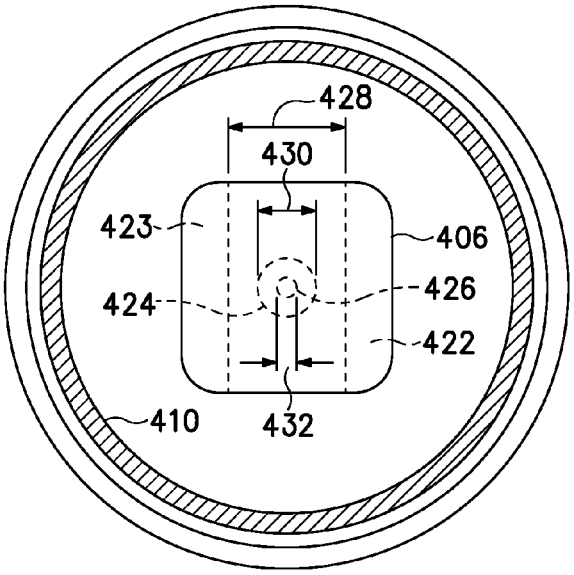
FIG. 3B is a cut bottom view of the lid portion of the high pressure food package of FIG. 3A.

FIG. 3B is a cut bottom view of the lid portion of the high pressure food package of FIG. 3A. As viewed from the bottom of the lid (or cap) 404, according to a preferred embodiment, a one-way membrane valve 406 is centered about the nipple 402 so that an opening 440 in the nipple is aligned with an opening 426 in the foil liner 408 and an opening 424 in the membrane valve 406. Gas injected into the nipple opening 440 passes through the foil liner opening 426, into the membrane valve opening 424, and the channel 420 between channel sides 422, 423 before beginning to fill the interior space 414 of the package 400. Preferably, the foil liner opening 426 has a dimension (or diameter) 432 that is at least as large as the dimension 442 of the nipple opening 440. Preferably, the valve opening 424 has a dimension 430 at least as large as the dimension 432 of the foil liner opening 426. In one embodiment, the membrane valve 406 comprises a channel 420 between channel sides 422, 423 having a width dimension 428 that is larger than the valve opening dimension 430 so that membrane material in the bottom layer 438 is able to flex upward (as internal pressure within the interior space 414 of the package builds) to seal the channel 420 and the valve opening 424.

Figure 3C:
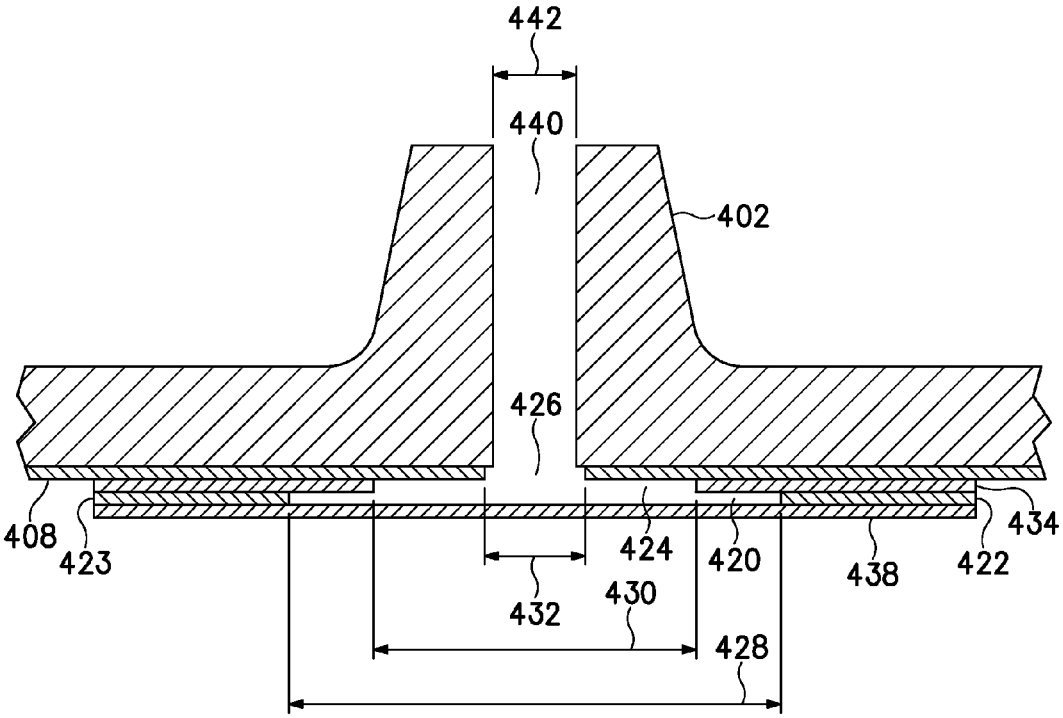
FIG. 3C is a detail sectional view of the one-way valve region of the lid of FIG. 3A.

FIG. 3C is a detail sectional view of the one-way valve region of the high pressure food package of FIG. 3A showing in greater detail the foil liner 408 with one-way membrane valve 406 loaded into the lid (cap) 404, according to one embodiment. FIG. 3C shows more clearly the layers comprising the valve and liner, in one embodiment. The component layers, from top to bottom, of the plastic cap 404 with a central nipple 402, an induction seal foil liner 408, and a one-way valve 406, which itself consists of three membrane layers 434, 422/423, 438. A channel in the middle layer 422/423 of the one-way valve 406 is forced open slightly by positive pressure applied from the nipple opening 440 and directed toward the center of the valve 406 to allow gas to flow in one direction, in this case, into the bottle 412. Back pressure on the bottom layer 438 of the one-way valve 406 collapses at least the bottom layer 438 to prevent back flow of gas out of the bottle 412 and nipple 402. In one embodiment, a small amount of viscous fluid, such as, for example, a drop of food-grade oil, may be placed in the valve opening 424 (which may then migrate into the channel 420) to help seal the channel 420 as back pressure deflects the bottom layer 438 to close the one-way valve.

The induction seal foil liner 408 may comprise a foil liner material coated on one side with a plastic material that heats when passed through the induction (or RF) energy field associated with induction sealing processes. The heated plastic coating then adheres to the surface in contact with the coating. Preferably, the plastic coating is oriented so as to adhere to the rim 410 of the bottle 412, and the foil liner 408 or the weld joint between the rim 410 and foil liner 408 is suitably designed so as to fail at a predetermined pressure. For example, the foil liner 408 may be designed to fail at 90 psi internal pressure. Preferably, the foil liner 408 is suitably designed so as to burst (or develop a leak at the weld joint with the rim 410) as the lid 404 of the package 400 is twisted off/open. In a preferred embodiment, as the lid 404 is opened, the seal fails and begins to release pressure. Once the lid 404 is removed, the foil liner 408 remains on the edge/rim 410 of the bottle 412 and may be peeled off by pulling back a tab of liner material that extends just beyond the edge/rim 410 of the bottle 412.

The present inventors discovered that if the foil liner seal weld is too strong, the seal may not fail soon enough when the cap is removed, resulting in a "pop" as the seal bursts abruptly. In a preferred embodiment, the strength of the weld between the foil liner 408 and the edge of the cup 410 is controlled such that the seal it creates is the weak link in the pressure integrity of the package. That is, the foil liner 408 detaches from the edge 410 of the cup 412 when the internal pressure reaches a predetermined value, e.g. 90 psi. At this point the package can no longer hold excess internal pressure and becomes incapable of preserving the effervescent effect. This safety feature addresses situations when a package may be thermally abused by a consumer resulting in internal fermentation of the food. Instead of excess pressure potentially bursting the package in uncontrolled or undesirable ways, the liner seal material is suitably designed to fail first and thereby allow pressure to escape through the threads between the cup 412 and lid 404.

In one embodiment, after initial removal of the lid 404 from the pressurized package 400, the foil seal will have been broken but may be kept in place (e.g. by only partially peeling back the foil liner 408) so that re-closing the lid 404 over the bottle 412 once again provides a package capable of retaining internal pressure. Additional CO2 may be injected into the package 400 to further extend the effervescence desired, for example, to maintain a higher fizziness level for the food product contained in the package (i.e. double inflation).

Figure 4A:
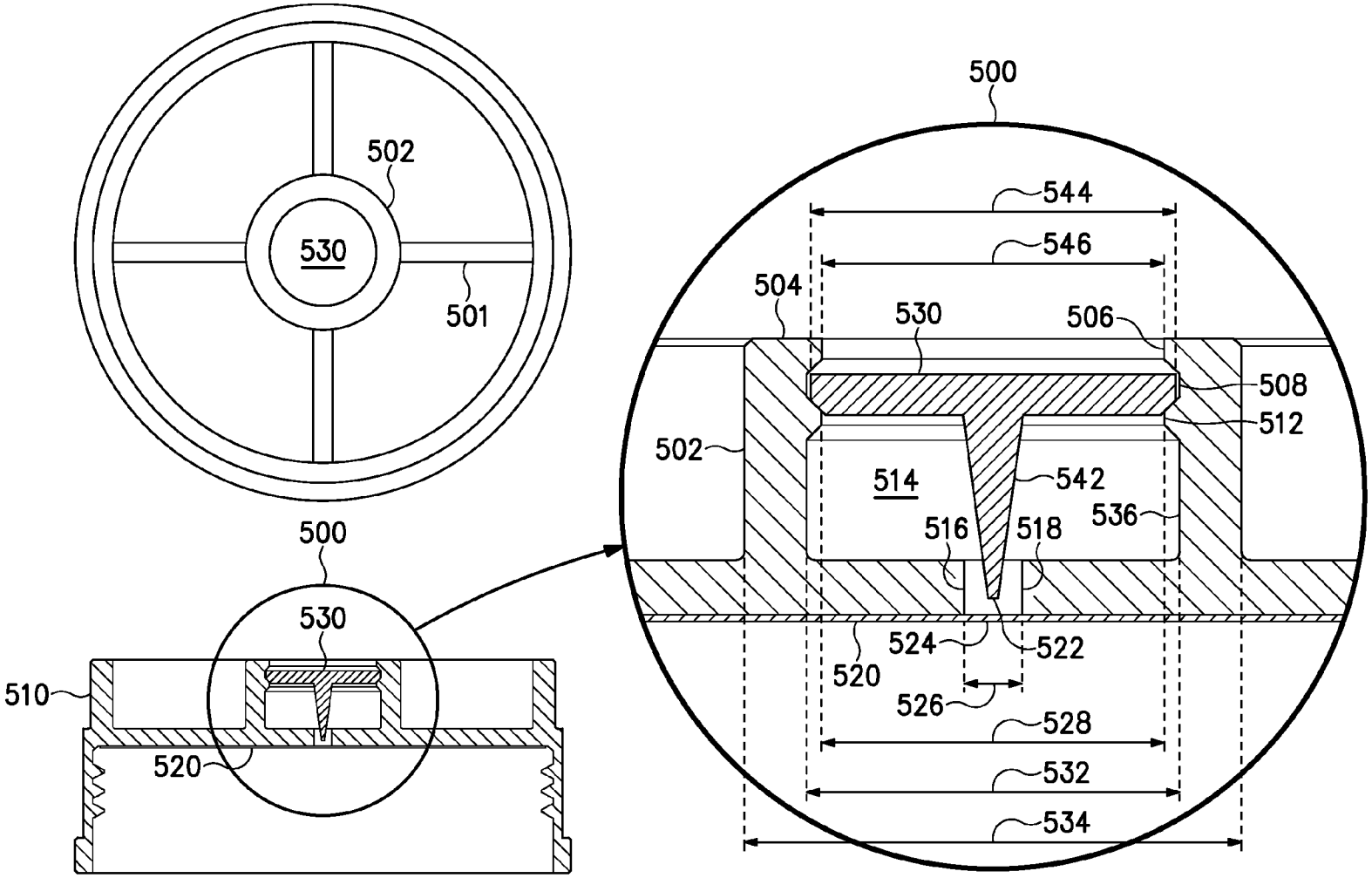
FIG. 4A illustrates top and cut side views of an exemplary lid with a puncture pin mechanism for releasing internal pressure prior to opening the package.

In one embodiment (as shown in FIG. 4A), a central plastic pin 542, covered (such as by a breakaway, perimeter perforated membrane, not shown) to prevent tampering prior to opening, is found in the central area of the lid. To depressurize the package prior to opening, the pin cap 530 is depressed which punctures the seal 520 and releases internal pressure through the rent created by the pin in the seal. The structure of the plastic pin housing 502 prevents the pin from being removed from the lid, only allowing for downward movement. In one embodiment, when you press the piercing element through the membrane liner and continue pressing the element downward, the diameter of the piercing element tapers/increases such that the piercing element (pin 542) eventually blocks the opening having sides 516, 518. In one embodiment this provides a resealing function, with subsequent excess pressure causing element/pin 542 to become unseated, lifting upward thereby allowing a further release of pressure. The high pressure food package may comprise a plastic cup and screw-on type threaded lid within which a quantity of product, such as a portion or a serving of fresh-cut fruits or vegetables, may be retained in a modified atmosphere (comprising, in part, pressurized carbon dioxide). In one embodiment, a foil liner in the lid is induction sealed to the rim of the cup to maintain the desired pressure. In one embodiment, a pre-determined amount of solid or liquid CO2 is placed into the container with the product just prior to sealing in order to sublimate into the volume and pressure of modified atmosphere desired.

In one embodiment, ribs 501 extend radially outward from pin housing 502 to ridge 510. Detail view 500 provides an exemplary pin cap 530 structure comprising a downward extending pin 543 held in an upward, undepressed position above narrowing material 512 of the pin housing 502 and just below narrowing material 506 formed at an upper border 504 of the pin housing 502. The pin housing 502 is shown circular in shape, with an outside diameter 534, although other non-circular shapes may be used (as well as non-circular shapes for the pin cap 530 and other associated structure. The pin cap 530 is shown retained between the diameter 546 of the upper narrowing material 506 and the diameter 528 of the lower narrowing material 512. The pin cap 530 is shown having a diameter 544 slightly wider than the diameter 528 at the narrowing material 512 region and slidably sized for downward travel to close space 514 when depressed. As the pin cap 530 is depressed so as to travel downward through a channel with sides 536 having a diameter 532, the pin cap 530 moves from its normal undepressed position 508 between the upper 506 and lower 512 narrowing material. As the tip 522 of the pin 542 travels downward and pierces seal 520, an opening in the seal 520 at 524, in one embodiment, provides a path for the release of pressure from the downward side of the seal 524 between sides 516, 518 of a hole having a diameter 526. In one embodiment, the pin 542 is tapered so as to eventually block the opening diameter 526 as the pin cap 530 is depressed downward. In one embodiment, continued depression of the pin cap 530 at least partially reseal the cup until excess pressure causes upward movement of the tapered pin 542 and subsequent release of pressure.

Figure 4B:
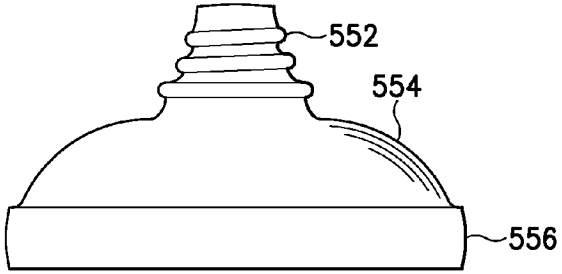
FIG. 4B is a side view of an exemplary lid which serves as an adapter between a wide access point, and a more narrow filling point capable of fitting into existing soda bottle manufacturing standards.

In one embodiment (as shown in FIG. 4B), the lid 554 of the package converges on a threaded bottle shape 552 identical to standard plastic soda bottles, making it possible for existing filling equipment to be used in production. The pieces of fruit or food product are first filled into the package, the wide portion of the lid 556 then screwed in place with an adequate U or 3-point seal, and then the package filled with gas or liquid CO2 using existing automated collar equipment to pressurize and carbonate the product.

Figure 4C:
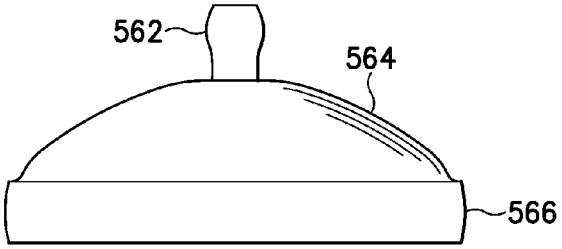
FIG. 4C is a side view of an exemplary lid with a poppet-style valve through which CO2 gas can be loaded into the package during filling and production, and also by which the consumer can release internal pressure prior to opening the package.

FIG. 4C shows another embodiment which utilizes existing one-way valve technology, so called 'poppet' valves 562, which are embedded into the lid 564 and provide for both inflation and depressurization of the package through the same valve.

Figure 5:
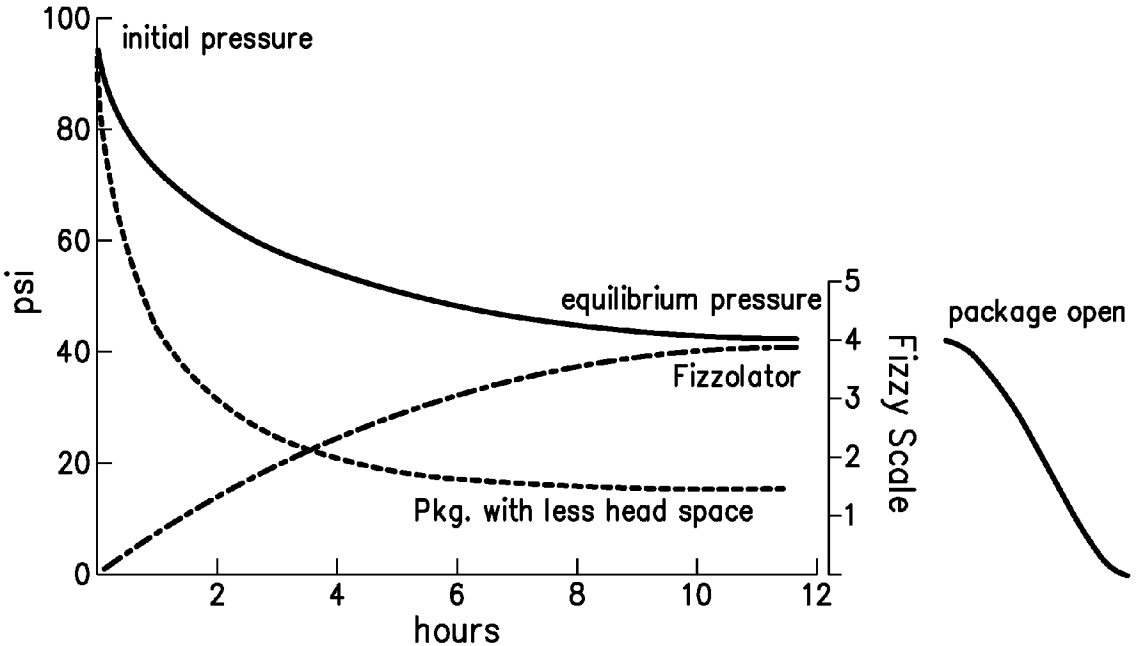
FIG. 5 illustrates exemplary simplified basic internal CO2 pressure and typical timing profiles involved in a retail package, and an exemplary effervescence (or Fizzy) rating scale.

FIG. 5 illustrates basic principles of a retail carbonating package and the pressure profiles during different steps. In one embodiment, dry ice snow or pellets are added to the package which is immediately sealed, and the initial internal pressures approach 100 psi and gradually equilibrates over several hours into the fruit by diffusion to an equlibrium pressure of about 40 psi. (Red/solid line) This stable pressure produces a product which on opening is rated about a "Fizzy 4" on the Fizzy Scale of 1-5 (where "1" is barely detectable effervescence and "5" is audible and visual bubbles and very strong effervescence). The dotted line illustrates a package with less head space, where the initial loading pressure is similar but because less total CO2 is added, the final carbonation is lower (−15 psi or "Fizzy 1"). The other curve (blue/dash-dot) represents a package with internal chemical production of CO2 like the "Fizzolator" (U.S. Ser. Nos. 12/271,797, 11/548,212) used in school lunch programs. Once the package is opened (far right curve shown in FIG. 5), a typical depressurization and loss of fizz occurs over about one hour, depending on fruit, temperature, and other factors. The pressure required to achieve a desired level of effervescence is a function of head space volume and time as described above. In one embodiment, the fill pressure is about 90 psi, which equilibrates after the food absorbs the CO2 gas to a final pressure of about 40 psi. A hand device may be used to inject the gas (e.g. CO2 or a CO2-O2 mixture) into each package through its nipple or one-way valve (ref. U.S. Ser. No. 11/943,964). The hand device preferably is suspended by a retractable mechanism and includes pressure sensors or switches for automatically stopping the flow of additional gas when the internal pressure of the package reaches a predetermined level (e.g. about 90 psi).

In one embodiment, a Fizzy rating of 4, indicating presence in the food product of easily detectable effervescence characterized by audible and visible bubbles, is a target minimum effervescence level for a particular consumer preference for said food product, and a Fizzy rating of 3, indicating presence in the food product of less easily detectable effervescence characterized by effervescence easily detectable at least by taste, is a target minimum effervescence level for a different particular consumer preference for the food product. In one embodiment, a Fizzy rating (or effervescence rating) of 3 represents a food product with effervescence that is easily detectable by the consumer's sense of taste, and a Fizzy rating of 4 represents a food product with more effervescence, effervescence that is easily detectable by the consumer's senses of vision (i.e. visual bubbles in the food product) and hearing (i.e. audible bubbles) in addition to the consumer's sense of taste (i.e. sensing the bubbles in the food product by taste). The Fizzy or effervescence rating for the food product is preferably chosen for a particular target consumer. For example, younger consumers may desire a food product such as apples or grapes with a higher level of effervescence than older consumers, or consumers in different geographic regions may prefer differing levels of effervescence.

Preferably, the cup 102 (or 412) may be sized for one, two, or three servings. In one embodiment, a single serving size is in the range of 2 oz to 3 oz. In one embodiment, a single serving package has a cup size of 2.6 oz (75 grams). One, two, or three servings may correspond with 2 oz, 4 oz, and 6 oz cup sizes, respectively. Cup sizes for one, two, or three services may correspond with cup sizes within ranges of 2-2.6 oz, 4-5.2 oz, and 6-7.8 oz, respectively. Other serving sizes, corresponding cup sizes, and ranges of cup sizes may be used. Preferably, the package is portable by hand and capable of being held in one hand.

Figure 6:
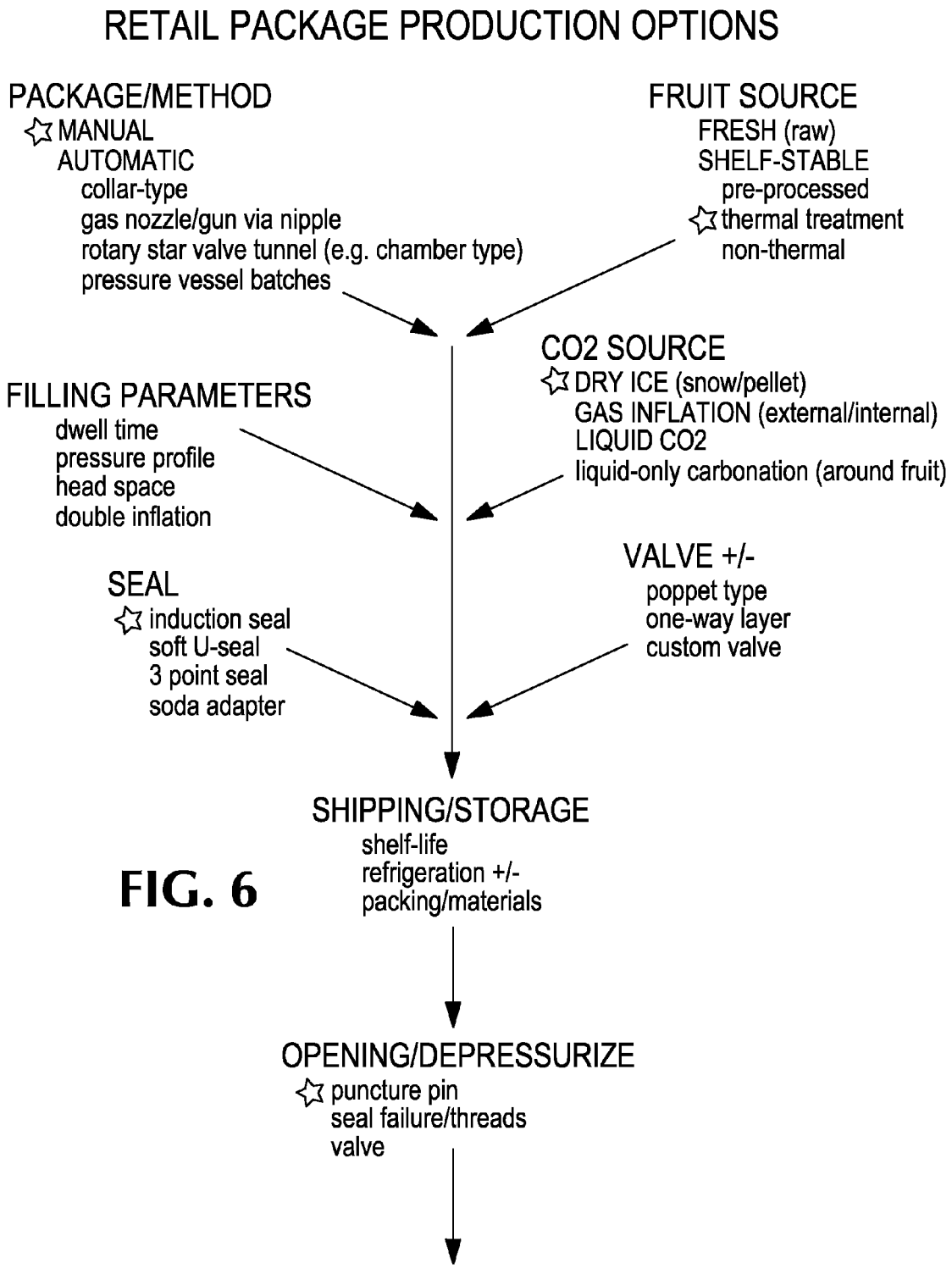
FIG. 6 is a concept map of various explored variables and design factors in a retail food carbonation system.

FIG. 6 describes a thorough but by no means exhaustive illustration of the various embodiments and combinations that can be used to create a high pressure retail food carbonation package system. The figure is a concept map of the explored variables and design factors. These include the actual package material and structure design, the source of food product and its treatment prior to filling, the filling parameters of the head space, the source of CO2, the type of seal used and whether or not a valve is used, the shipping and storage considerations (greatly influenced by food type), and the depressurizing and opening mechanism. Many possible combinations will result in a successful outcome, but the scalability and costs of each system vary greatly. Each of the separable aspects may be mixed and matched in various different embodiments. For example, in one embodiment (starred items in FIG. 6) a PETE cup and lid are filled with shelf-stable thermally treated fruit, and CO2 in the form of dry ice snow is used to manually fill, seal, and pressurize the package with CO2 using an induction seal, while a puncture pin (as in FIG. 4A) is used by the consumer to depressurize the package prior to opening by unscrewing the lid.

FIG. 7 shows an embodiment having a lid A with a rim gripping seal and pressure releasing pull-tab 2. The lid A fits into a rim of a cup B where positive pressure within the cup B helps strengthen the seal between the cup B and lid A. The opening is a tab 2 built into the lid A which rips open the material (e.g. plastic) of the lid A to depressurize the cup B when it is time to open the package. The package (i.e. cup B and lid A) may be pressurized with an internal chemical reaction, dry ice, or pressurized through a one-way valve as described herein for other embodiments. As shown in FIG. 7, a deformable internal pressure indicator 1 is included to indicate sufficient internal pressure (e.g. indicator deflecting/deformed in an upward (convex) direction, away from cup B) or insufficient internal pressure (e.g. indicator in a concave, deflected downward direction). Pull-tab 2 is shown with a pull-tab-to-lid interface 3. In one embodiment, pressure release/scored region 6 in the underside of the lid A provides a weakened area to allow outward movement of the pull-tab 2 to rip open the lid material. Also shown is, in one embodiment, shoulder material (tamper-proof wrapping) 4 and container body/labeling 5.

In addition to the aforementioned embodiments, a type of modified "aerosol can" type package (not shown) may be used whereby product is stored in a can that looks like an aerosol can made of metal or plastic, where the base of the package is where the product is filled by the producer of the product, and sealed, and also where the consumer safely opens the product to retrieve and consume the product after depressing an aerosol button/valve assembly at the opposite side of the package. An advantage of this type of package and method of its use is that one side of the package comprises mechanisms to fill and release gas safely into and from the package, and the other side of the package is used to seal in and retrieve the food product.

All patents and patent applications referenced herein by patent number and/or patent application serial number are hereby incorporated by reference in their entireties.

The terms and expressions which have been employed in the forgoing specification are used therein as terms of description and not of limitation, and there is no intention in the use of such terms and expressions of excluding equivalence of the features shown and described or portions thereof, it being recognized that the scope of the invention is defined and limited only by the claims which follow.

We claim:

1. A method utilizing a high pressure food package comprising:

(a) filling an interior space of a single-hand holdable sized cup with a quantity of food product, said food product specifically chosen so as to be capable of absorbing sufficient CO2 to produce effervescence easily detectable by a person later removing said food product from said cup;

(b) introducing a predetermined amount of CO2 into said cup before, after, or simultaneously with the step of filling said interior space of said cup with said food product;

(c) torquing a threaded lid onto cooperatively mating threads on said cup to a predetermined force, said threaded lid and cooperatively mating threads on said cup including a seal comprising material that deflects with increased internal pressure in said interior space relative to external pressure outside of said interior space so as to increase said seal's strength as said internal pressure increases relative to said external pressure, wherein said lid further comprises a puncturable seal material;

(d) pressurizing said internal space of said cup with CO2 and generating sufficient effervescence in said food product to produce effervescence easily detectable by said person later removing and consuming said food product from said interior space of said cup;

(e) fixing in place the relative rotational positions of said lid and said cup with anti-tamper material for product quality assurance and to permit retail sale of the resulting packaged carbonated food product;

(f) allowing said internal pressure within said interior space to stabilize to a predetermined equilibrium internal pressure sufficient to maintain said generated effervescence in said food product;

(g) transporting and holding said package for retail sale after or simultaneous with the step of allowing said internal pressure within said interior space to stabilize;

(h) providing a push button for a person to depressurize said interior space before removing said lid from said cup, wherein depressurizing said interior space of said cup comprises pushing a button on said lid to puncture said puncturable seal material to allow escape of internal pressure relative to external pressure through an opening in said puncturable seal material created by pushing said button; and (i) providing means for said person to hold said cup in one hand and twist said lid off of the cup with another hand to expose said carbonated food product within said cup, and to use fingers of one hand to remove said carbonated food product from said interior space of said cup.

2. The method of claim 1 further comprising pressurizing said interior space with CO2 with dry ice.

3. The method of claim 2 wherein pressure within said interior space varies over a period of approximately ten to twelve hours to reach said equilibrium internal pressure.

4. The method of claim 3 wherein said equilibrium internal pressure is approximately 40 psi.

5. The method of claim 4 wherein said equilibrium internal pressure of approximately 40 psi generates effervescence in said food product that is easily detectable by a consumer using one or more of said consumer's senses.

6. The method of claim 5 wherein easily detectable effervescence comprises audible and visible bubbles.

7. The method of claim 6 further comprising designating said easily detectable effervescence to represent a Fizzy rating of about 4.

8. The method of claim 1 wherein sealing material formed about said lid or said cup comprises annular material forming a bore seal that increases its sealing force with an increase in said internal pressure relative to said external pressure.

9. The method of claim 1 wherein depressurizing said interior space results in a start of escape of CO2 from said food product over a period of time resulting in a drop of a Fizzy rating of said food product.

10. The method of claim 9 wherein a Fizzy rating of 5 is a highest rating of said food product's level of effervescence, indicating presence in said food product of very strong effervescence characterized by strongly audible and visible bubbles, and wherein a Fizzy rating of 1 is a low rating of said food product's level of effervescence, indicating barely detectable effervescence in said food product.

11. The method of claim 10 wherein a Fizzy rating of 4, indicating presence in said food product of easily detectable effervescence characterized by audible and visible bubbles, is a target minimum effervescence level for a first consumer preference for said food product, and a Fizzy rating of 3, indicating presence in said food product of less easily detectable effervescence characterized by effervescence easily detectable at least by taste, is a target minimum effervescence level for a second consumer preference for said food product.

12. The method of claim 1 wherein said seal comprises a two-point seal formed between engagable surfaces of said lid and said cup.

13. The method of claim 1 wherein said seal comprises a three-point seal formed between engagable surfaces of said lid and said cup.

14. A method utilizing a high pressure food package comprising:

(a) filling an interior space of a single-hand holdable sized cup with a quantity of food product, said food product specifically chosen so as to be capable of absorbing sufficient CO2 to produce effervescence easily detectable by a person later removing said food product from said cup;

(b) introducing a predetermined amount of CO2 in the form of a quantity of dry ice into said cup before, after, or simultaneously with the step of filling said interior space of said cup with said food product;

(c) torquing a threaded lid onto cooperatively mating threads on said cup to a predetermined force, said threaded lid and cooperatively mating threads on said cup including a seal comprising material that deflects with increased internal pressure in said interior space relative to external pressure outside of said interior space so as to increase said seal's strength as said internal pressure increases relative to said external pressure, wherein sealing material is formed about said lid or said cup and comprises annular material forming a bore seal that increases its sealing force with an increase in said internal pressure relative to said external pressure, wherein said lid further comprises a puncturable seal material;

(d) pressurizing said internal space of said cup with CO2 using said quantity of dry ice and generating sufficient effervescence in said food product to produce effervescence easily detectable by said person later removing and consuming said food product from said interior space of said cup;

(e) fixing in place the relative rotational positions of said lid and said cup with anti-tamper material for product quality assurance and to permit retail sale of the resulting packaged carbonated food product;

(f) allowing said internal pressure within said interior space to stabilize to a predetermined equilibrium internal pressure sufficient to maintain said generated effervescence in said food product;

(g) transporting and holding said package for retail sale after or simultaneous with the step of allowing said internal pressure within said interior space to stabilize;

(h) providing a push button for a person to depressurize said interior space before removing said lid from said cup, wherein depressurizing said interior space of said cup comprises pushing a button on said lid to puncture said puncturable seal material to allow escape of internal pressure relative to external pressure through an opening in said puncturable seal material created by pushing said button; and (i) providing means for said person to hold said cup in one hand and twist said lid off of the cup with another hand to expose said carbonated food product within said cup, and to use fingers of one hand to remove said carbonated food product from said interior space of said cup, wherein depressurizing said interior space results in a start of escape of CO2 from said food product over a period of time resulting in a drop of a Fizzy rating of said food product;

a Fizzy rating of 5 is a highest rating of said food product's level of effervescence, indicating presence in said food product of very strong effervescence characterized by strongly audible and visible bubbles, and wherein a Fizzy rating of 1 is a low rating of said food product's level of effervescence, indicating barely detectable effervescence in said food product; and a Fizzy rating of 4, indicating presence in said food product of easily detectable effervescence characterized by audible and visible bubbles, is a target minimum effervescence level for a first consumer preference for said food product, and a Fizzy rating of 3, indicating presence in said food product of less easily detectable effervescence characterized by effervescence easily detectable at least by taste, is a target minimum effervescence level for a second consumer preference for said food product.

15. The method of claim 14 wherein pressure within said interior space varies over a period of approximately ten to twelve hours to reach said equilibrium internal pressure, said equilibrium internal pressure is approximately 40 psi, said equilibrium internal pressure of approximately 40 psi generates effervescence in said food product that is easily detectable by a consumer using one or more of said consumer's senses, and easily detectable effervescence comprises audible and visible bubbles; and further comprising designating said easily detectable effervescence to represent a Fizzy rating of about 4.

16. A method utilizing a high pressure food package comprising:

(a) filling an interior space of a single-hand holdable sized cup with a quantity of food product, said food product specifically chosen so as to be capable of absorbing sufficient CO2 to produce effervescence easily detectable by a person later removing said food product from said cup;

(b) introducing a predetermined amount of CO2 in the form of a quantity of dry ice into said cup before, after, or simultaneously with the step of filling said interior space of said cup with said food product;

(c) torquing a threaded lid onto cooperatively mating threads on said cup to a predetermined force, said threaded lid and cooperatively mating threads on said cup including a seal comprising material that deflects with increased internal pressure in said interior space relative to external pressure outside of said interior space so as to increase said seal's strength as said internal pressure increases relative to said external pressure, wherein said lid further comprises a puncturable seal material;

(d) pressurizing said internal space of said cup with CO2 using said quantity of dry ice and generating sufficient effervescence in said food product to produce effervescence easily detectable by said person later removing and consuming said food product from said interior space of said cup;

(e) fixing in place the relative rotational positions of said lid and said cup with anti-tamper material for product quality assurance and to permit retail sale of the resulting packaged carbonated food product;

(f) allowing said internal pressure within said interior space to stabilize to a predetermined equilibrium internal pressure sufficient to maintain said generated effervescence in said food product, wherein pressure within said interior space varies over a period of approximately ten to twelve hours to reach said equilibrium internal pressure of approximately 40 psi;

(g) transporting and holding said package for retail sale after or simultaneous with the step of allowing said internal pressure within said interior space to stabilize;

(h) providing a push button for a person to depressurize said interior space before removing said lid from said cup, wherein depressurizing said interior space of said cup comprises pushing a button on said lid to puncture said puncturable seal material to allow escape of internal pressure relative to external pressure through an opening in said puncturable seal material created by pushing said button; and (i) providing means for said person to hold said cup in one hand and twist said lid off of the cup with another hand to expose said carbonated food product within said cup, and to use fingers of one hand to remove said carbonated food product from said interior space of said cup, wherein depressurizing said interior space results in a start of escape of CO2 from said food product over a period of time resulting in a drop of a Fizzy rating of said food product;

a Fizzy rating of 5 is a highest rating of said food product's level of effervescence, indicating presence in said food product of very strong effervescence characterized by strongly audible and visible bubbles, and wherein a Fizzy rating of 1 is a low rating of said food product's level of effervescence, indicating barely detectable effervescence in said food product; and a Fizzy rating of 4, indicating presence in said food product of easily detectable effervescence characterized by audible and visible bubbles, is a target minimum effervescence level for a first consumer preference for said food product, and a Fizzy rating of 3, indicating presence in said food product of less easily detectable effervescence characterized by effervescence easily detectable at least by taste, is a target minimum effervescence level for a second consumer preference for said food product.

* * * * *